US008632326B2

(12) United States Patent
Yeon

(10) Patent No.: US 8,632,326 B2
(45) Date of Patent: Jan. 21, 2014

(54) MANUFACTURING DEVICE OF SPHERICAL MAGNESIUM FINE POWDER

(76) Inventor: Kyu Yeub Yeon, Cheongju-shi (KR)

( * ) Notice: Subject to any disclaimer, the term of this patent is extended or adjusted under 35 U.S.C. 154(b) by 418 days.

(21) Appl. No.: 13/115,905

(22) Filed: May 25, 2011

(65) Prior Publication Data

US 2011/0293763 A1 Dec. 1, 2011

(30) Foreign Application Priority Data

May 26, 2010 (KR) ..... 10-2010-0049327

(51) Int. Cl.
*B22F 9/08* (2006.01)

(52) U.S. Cl.
USPC ..... 425/7; 425/6; 425/8; 264/5; 264/37.14; 75/331; 75/338; 75/343; 148/420; 148/666; 266/227

(58) Field of Classification Search
CPC ..... B22F 9/08; B22F 9/082; B22F 2303/35; B22F 2998/00; B22F 2999/00
USPC ..... 425/6, 7, 8, 10; 264/5, 8, 12, 13, 37.14; 75/331, 337, 338, 342, 343; 148/420, 148/666, 667; 266/216, 227
See application file for complete search history.

(56) References Cited

U.S. PATENT DOCUMENTS 1,356,780 A * 10/1920 Nicol ..... 425/7
2,209,964 A * 8/1940 Ferguson ..... 75/338
2,638,626 A * 5/1953 Golwynne ..... 425/7
2,638,630 A * 5/1953 Golwynne ..... 75/338
2,965,922 A * 12/1960 Toulmin, Jr. ..... 425/7
3,281,893 A * 11/1966 Ayers ..... 425/7
3,334,408 A * 8/1967 Ayers ..... 419/3
3,695,795 A * 10/1972 Jossick ..... 425/7
3,814,558 A * 6/1974 Ayers ..... 425/7
3,966,374 A * 6/1976 Honnorat et al. ..... 425/7
4,374,633 A * 2/1983 Hart ..... 425/7
4,449,902 A * 5/1984 Ramser ..... 425/7
4,464,103 A * 8/1984 Ramser et al. ..... 425/7
4,466,786 A * 8/1984 Booz et al. ..... 425/7
4,468,182 A * 8/1984 Booz et al. ..... 425/7
4,468,183 A * 8/1984 Ramser et al. ..... 425/7
4,469,313 A * 9/1984 Ichidate et al. ..... 266/207

(Continued)

FOREIGN PATENT DOCUMENTS

JP 2004182521 A 7/2004
KR 1020050034310 A 4/2005

*Primary Examiner* — Seyed Masoud Malekzadeh
(74) *Attorney, Agent, or Firm* — Robert D. Atkins; Patent Law Group: Atkins & Associates, P.C.

(57) ABSTRACT

A device for manufacturing finely powdered spherical magnesium includes a gas compressor that compresses argon gas, a gas heating unit that heats the compressed argon gas, and a tundish that receives molten magnesium. The device further includes a reactor having a nozzle injection unit that injects heated argon gas into the reactor, a recovery unit that recovers magnesium powder produced in the reactor, and a first gas cooler that cools the argon gas passing through the recovery unit. The device further includes a filtering unit that filters the cooled argon gas, a buffer tank that receives the filtered argon gas, and a compression blower that adiabatically compresses the argon gas. The device further includes a second gas cooler that cools the compressed argon gas, an adiabatic expansion duct that adiabatically expands the cooled argon gas, supplies the expanded argon gas to the reactor, and cools the magnesium powder.

8 Claims, 6 Drawing Sheets

(56) References Cited

U.S. PATENT DOCUMENTS

| | | | | | |
|---|---|---|---|---|---|
| 4,578,022 | A * | 3/1986 | Kenney | 425/7 |
| 4,629,407 | A * | 12/1986 | Amlinger | 425/7 |
| 4,838,912 | A * | 6/1989 | Amlinger | 62/616 |
| 4,897,111 | A * | 1/1990 | Jonsson et al. | 75/337 |
| 5,120,352 | A * | 6/1992 | Jackson et al. | 75/346 |
| 5,164,198 | A * | 11/1992 | Bauckhage et al. | 425/6 |
| 5,589,199 | A * | 12/1996 | Anderson et al. | 425/10 |
| 8,062,406 | B2 * | 11/2011 | Igarashi et al. | 75/338 |
| 8,329,072 | B2 * | 12/2012 | Lang et al. | 264/7 |
| 8,333,924 | B2 * | 12/2012 | Kawamura et al. | 420/402 |
| 2002/0134198 | A1 | 9/2002 | Edlinger | |
| 2002/0182280 | A1 * | 12/2002 | Northup et al. | 425/6 |
| 2008/0271568 | A1 * | 11/2008 | Dunkley | 75/338 |
| 2011/0113925 | A1 * | 5/2011 | Perry | 75/363 |

* cited by examiner

MANUFACTURING DEVICE OF SPHERICAL MAGNESIUM FINE POWDER

CLAIM OF FOREIGN PRIORITY

The present application claims priority to Korean Patent Application No. 10-2010-0049327, filed May 26, 2010, which is hereby incorporated by reference in its entirety.

FIELD OF THE INVENTION

The present invention relates to a manufacturing device of spherical magnesium fine powder, and more particularly, to a manufacturing device of spherical magnesium fine powder to reduce cost, to improve the degree of surface stability and spheroidizing and to reduce the risk of fire.

BACKGROUND OF THE INVENTION

Generally, magnesium powder has been mainly used in the fields of tracers, propellants and lighting for military use, as a de-sulfuring agent for steel making and as a chemical agent for industrial use. Recently, the size of military products and industrial products using magnesium powder have become smaller and smaller and thus magnesium powder having improved spheroidizing degree and smaller particle degree is required so that a large amount of magnesium powder can be filled within these military and industrial products.

However, through prior magnesium manufacturing devices, spheroidizing degree of magnesium is limited and further impurities are mixed in the final products which deteriorate the quality of the products and increase the risk of fire during the course of manufacturing magnesium powder.

SUMMARY OF THE INVENTION

The present invention has been proposed to solve the aforementioned drawbacks of the prior art, and one objective of the present invention relates to providing a spherical fine magnesium powder manufacturing device in which high temperature molten magnesium and high temperature argon gas are collided to produce magnesium powder and then the remaining argon gas is cooled and used for cooling produced magnesium powder. Accordingly, cost is saved and further surface stability degree and spheroidizing degree can be improved.

Another objective of the present invention relates to providing a spherical fine magnesium powder manufacturing device in which clean molten magnesium without impurities such as sludge and metal oxide is only used in manufacturing magnesium powder and thus high quality magnesium powder is obtained.

Another objective of the present invention relates to providing a spherical fine magnesium powder manufacturing device in which molten magnesium and argon gas are injected upwardly in a reactor, prominently reducing the risk of fire.

In order to achieve the aforementioned objectives a manufacturing device of spherical magnesium fine powder is provided, comprising: a gas compressor for receiving argon gas from a gas storage unit and compressing it; a gas heating unit for heating argon gas compressed in the gas compressor; a tundish for receiving molten magnesium from a magnesium melting furnace in which magnesium ingot is melted and molten magnesium is formed; a reactor which is provided with a nozzle injection unit for receiving argon gas heated through the gas heating unit and injecting it, and which forms magnesium powder by colliding molten magnesium supplied from the tundish with argon gas; a recovery unit for recovering magnesium powder produced in the reactor; a first gas cooler for cooling argon gas passing through the recovery unit; a filtering unit for removing dust contained in argon gas having decreased temperature through the first gas cooler; a buffer tank for receiving argon gas with dust being removed from the filtering unit; a compression blower for receiving argon gas from the buffer tank and adiabatically compressing argon gas; a second gas cooler for receiving argon gas which is compressed to increase temperature in the compression blower and cooling it; and an adiabatic expansion duct for expanding adiabatically argon gas cooled and supplied from the second gas cooler, supplying the expanded argon gas to the reactor, and cooling produced magnesium powder inside the reactor.

Here, a refining furnace for refining molten magnesium is further provided between the magnesium melting furnace and the tundish to supply refined molten magnesium to the tundish, and the refining furnace comprises: a heat-resistant pot inside of which a barrier having a predetermined height is formed to partition inner space thereof; a cover which opens and closes an opened upper face of the heat-resistant pot, and on one side of which a casting melt pipe connected to the magnesium melting furnace and guiding molten magnesium to one space of partitioned inner spaces of the heat-resistant pot is formed; a tapping vessel which is provided on another space of partitioned inner space of the heat-resistant pot except for the space on which the casting pipe is arranged, and on a bottom face of which a casting melt input hole is formed; a cylinder valve which is provided in the cover and opens and closes the casting melt input hole of the tapping vessel; a transfer pipe which is provided on the cover and guides molten magnesium inside the tapping vessel to the tundish; and a constant amount casting melt transferring unit which is arranged to pass through the cover and allows constant amount of molten magnesium to be outputted through the transfer pipe.

According to one aspect of the present invention, the casting melt transferring unit comprises: a gas injection pipe which is arranged to pass through the cover and allows inner pressure of the tapping vessel to be increased by injecting argon gas to the inside of the tapping vessel and molten magnesium to be outputted through the transferring pipe; a gas output pipe which is arranged to pass through the cover and allows argon gas to be outputted when inner pressure of the tapping vessel is high; a gas supplying tank which is connected to the gas injection pipe and supplies argon gas; and an outputted gas storage tank which is connected to the gas output pipe and stores outputted argon gas.

In addition, the tundish is provided on a lower side of the reactor and a casting melt supplying pipe for supplying upwardly molten magnesium is provided between the tundish and the reactor, and the nozzle injection unit is provided on a lower side of the reactor and a nozzle provided in the nozzle injection unit injects upwardly argon gas to the inside of the reactor so that molten magnesium supplied upwardly to the inside of the reactor through the casting supplying pipe is collided with argon gas.

Meanwhile, an oxidation agent supplying unit is connected to a tube for supplying argon gas from the argon gas storage unit to the compressor and argon gas mixed with oxidation agent is supplied to the compressor.

According to the manufacturing device of spherical magnetic fine powder, argon gas which decreases in temperature passing through the first gas cooler, the second gas cooler and the adiabatic expansion duct is supplied to the reactor and the magnesium powder is cooled rapidly and thus surface oxidation degree of magnesium powder is controlled uniformly, improving surface stability degree and spheroidizing degree.

Additionally, argon gas is collided with molten magnesium supplied from the tundish in the reactor to form magnesium powder and cooled, and then is supplied again to the reactor, saving high priced argon gas.

Meanwhile, sludge and oxides produced when magnesium is melted in a magnesium melting furnace are removed firstly in the barrier of the refining furnace and removed secondly in the sludge filter of the transfer pipe and then molten magnesium is supplied to the reactor, and thus blocking of pipe with sludge or oxides can be avoided when molten magnesium is transferred using pipes and further quality decrease of magnesium powder can be avoided.

Besides, inner pressure of the tapping vessel is kept at constant using argon gas injection and output through the gas injection pipe and the gas output pipe so that constant amount of molten magnesium is supplied from the tapping vessel to the tundish, making magnesium powder size to be constant.

In addition, argon gas supplied to the reactor is compressed and heated using the gas compressor and the gas heating unit so that argon gas having increased flow velocity is supplied to the reactor and collided with magnesium melt supplied from the tundish, obtaining fine magnesium powder.

Finally, molten magnesium from the tundish and argon gas passing through the gas compressor and the gas adiabatic expansion unit are injected upwardly to collide, decreasing fire occurrence risk.

DETAILED DESCRIPTION OF THE DRAWINGS

The preferred embodiments of a spherical fine magnesium powder manufacturing device according to the present invention will be described in detail referring to the accompanied drawings. However, it has to be understood that the present invention is not limited to the provided embodiments without departing from the spirit of the present invention.

Figure 1:
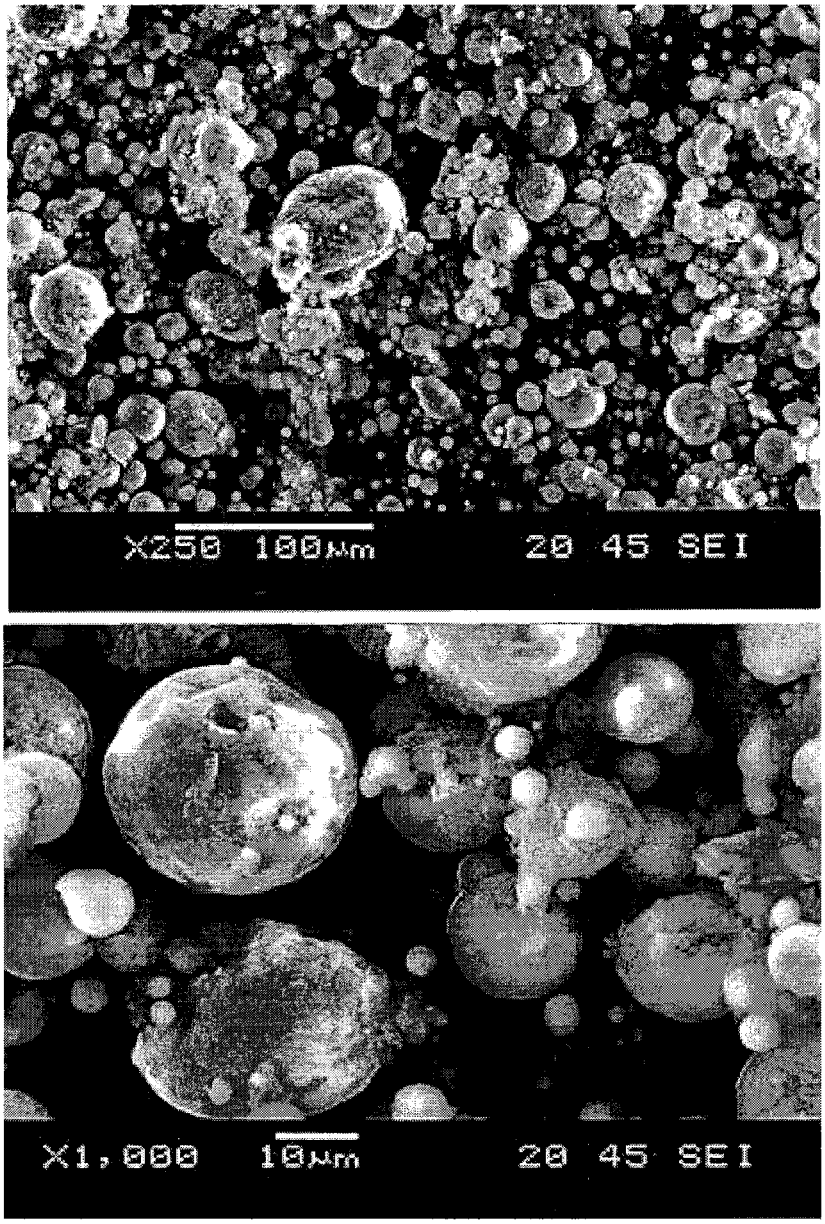
FIG. 1 is an electron scanning microscopic picture of magnesium powder produced using prior gas injecting method.
Figure 2:
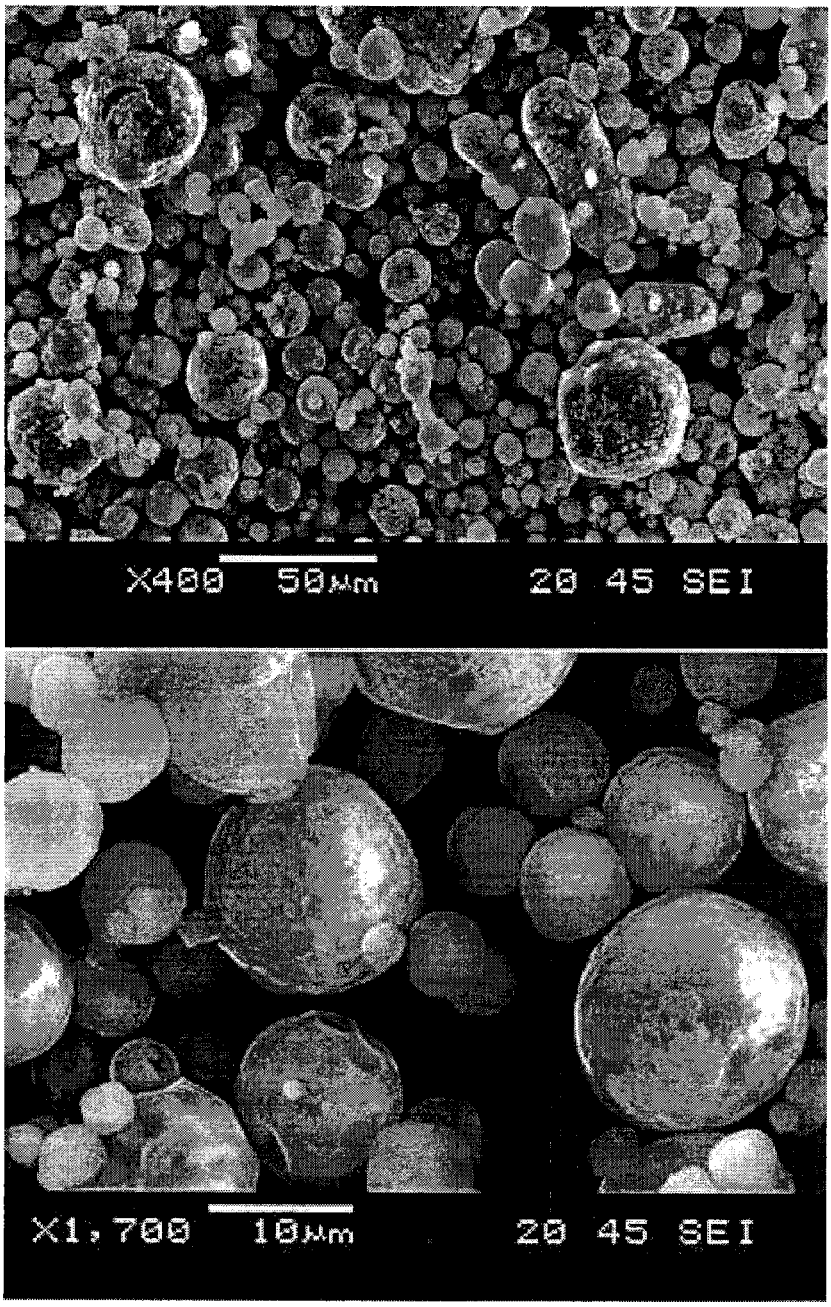
FIG. 2 is an electron scanning microscopic picture of surface of magnesium powder produced using prior gas injection method.
Figure 3:
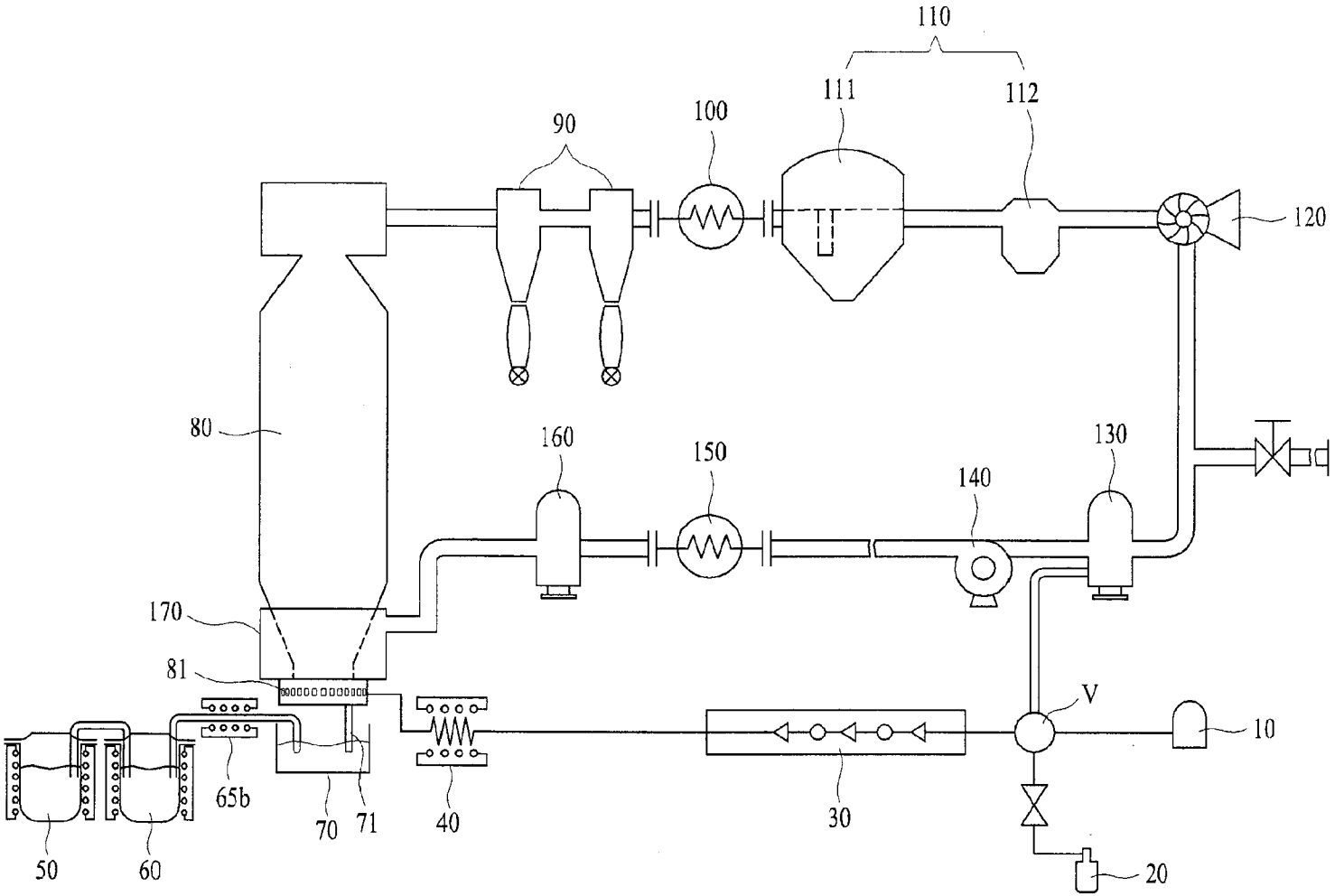
FIG. 3 shows schematically a spherical fine magnesium powder manufacturing device according to the present invention.
Figure 4:
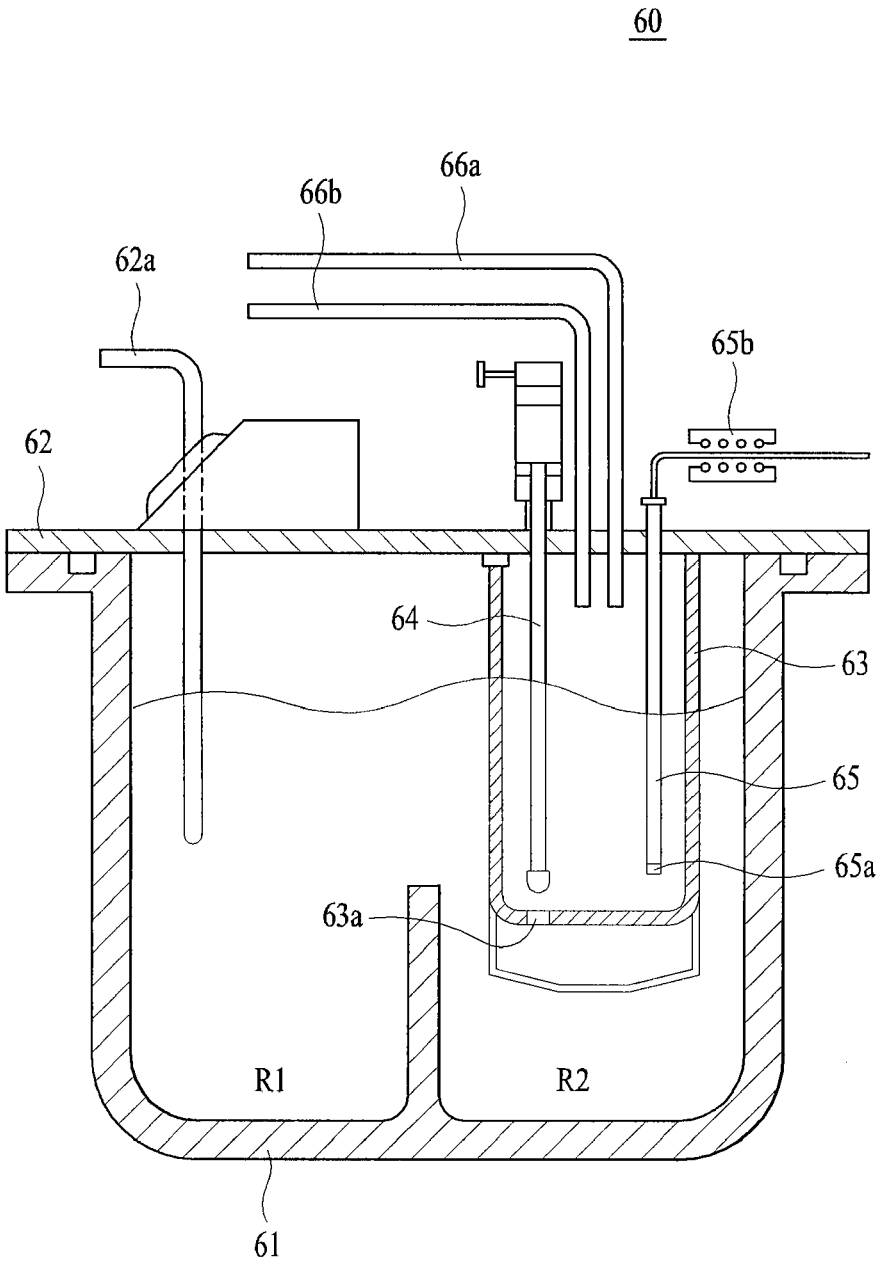
FIG. 4 shows schematically a refining furnace of a spherical fine magnesium powder manufacturing device according to the present invention.
Figure 5:
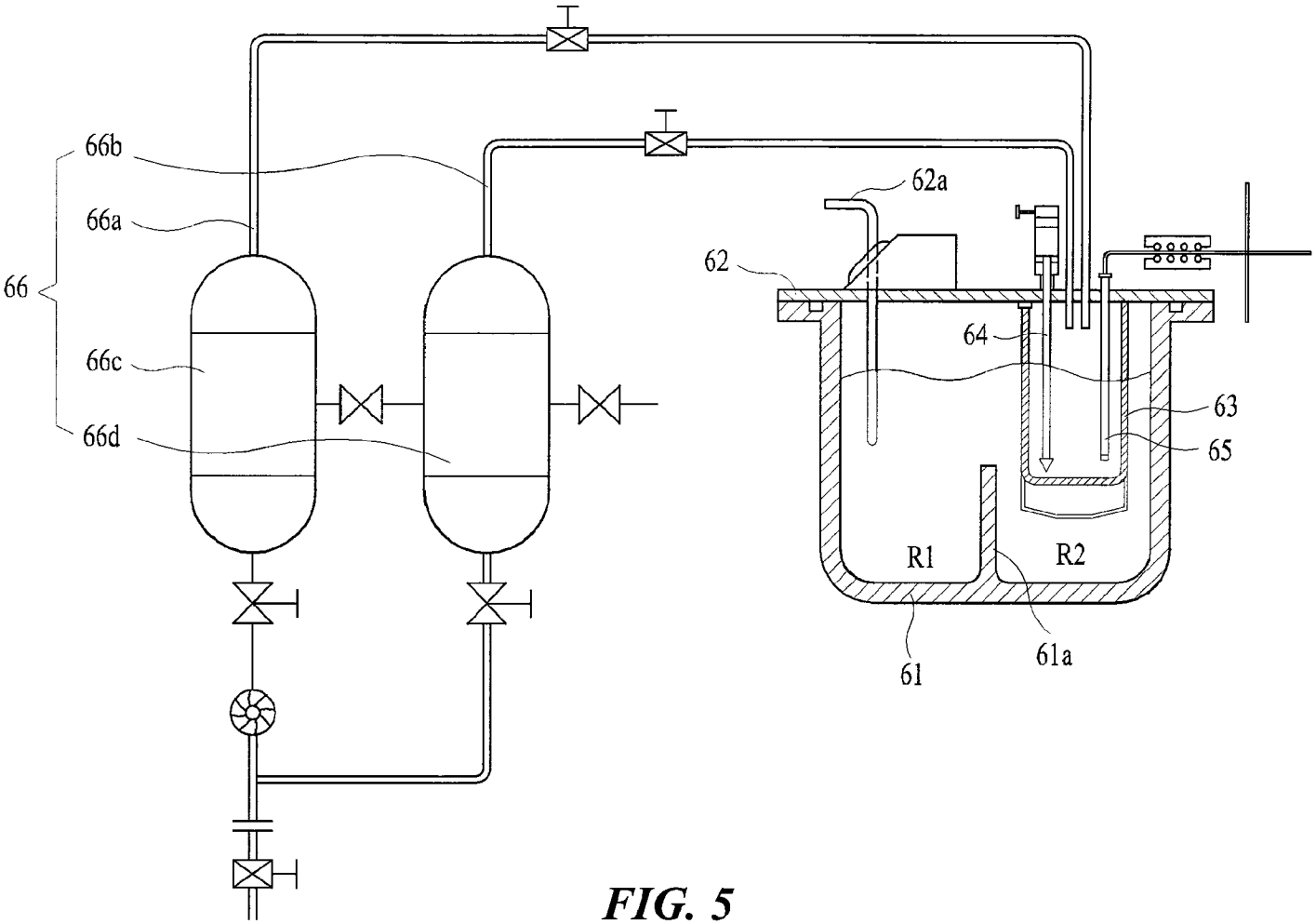
FIG. 5 shows schematically a constant amount transfer unit of a spherical fine magnesium powder manufacturing device according to the present invention.

Referring again to the accompanying drawings, FIG. 3 shows schematically a spherical fine magnesium powder manufacturing device according to the present invention, FIG. 4 shows schematically a refining furnace of a spherical fine magnesium powder manufacturing device according to the present invention, FIG. 5 shows schematically a constant amount transfer unit of a spherical fine magnesium powder manufacturing device according to the present invention.

Figure 6:
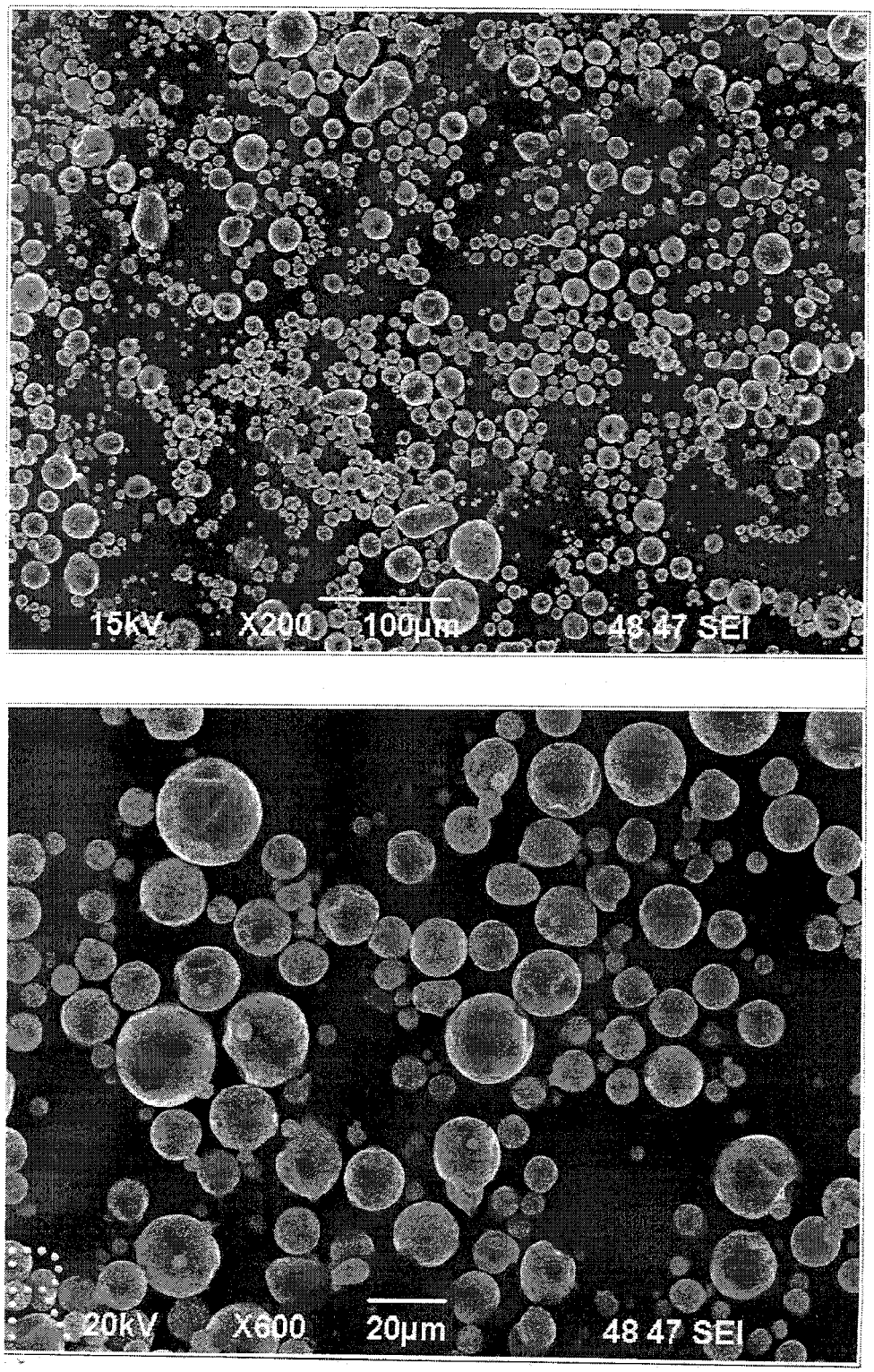
FIG. 6 is an electron scanning microscopic picture of magnesium powder produced using a spherical fine magnesium powder manufacturing device according to the present invention.

Meanwhile, FIG. 6 is an electron scanning microscopic picture of magnesium powder produced using a spherical fine magnesium powder manufacturing device according to the present invention.

A spherical fine magnesium manufacturing device according to the present invention comprises an argon gas storage unit 10, a gas compressor 30, a gas heating unit 40, a magnesium melting furnace 50, a refining furnace 60, a tundish 70, a reactor 80, a recovery unit 90, a first gas cooler 100, a filtering unit 110, a buffer tank 130, a compression blower 140, a second gas cooler 150, a static pressure buffer 160, and an adiabatic expansion duct 170. Here, the argon gas storage unit 10 stores argon gas inside thereof and supplies it to the gas compressor 30, and the gas compressor 30 is connected to the argon gas storage unit 10 with a pipe and receives argon gas from the argon gas storage unit 10 and compresses the argon gas. The reason for compressing argon gas is that argon gas transfer speed is accelerated for manufacturing a spherical fine magnesium powder according to the present invention. That is, magnesium powder size is inversely proportioned to injection speed of argon gas which is collided with molten magnesium inside the reactor 80, and thus argon gas is compressed to increase argon gas transfer speed and then magnesium powder formed inside the reactor 80 becomes a fine size.

Here, an oxidizing agent supplying unit 20 is connected to a pipe for supplying argon gas from the argon gas storage unit 10 to the gas compressor 30. When magnesium powder is produced, a predetermined oxidation layer has to be formed on a surface of magnesium powder to avoid spontaneous combustion. Therefore, in order to avoid the spontaneous combustion, oxidation agent is mixed with argon gas and the mixed argon gas is supplied to the gas compressor 30.

Meanwhile, the heating unit 40 is connected to the gas compressor with a pipe and receives compressed argon gas from the gas compressor 30 and heats it. The argon gas passing through the gas compressor 30 is heated by the heating unit 40 to further accelerate flow velocity of the argon gas to produce magnesium powder having fine magnesium powder.

Additionally, the magnesium melting furnace 50 melts solid state magnesium ingot to make liquid state molten magnesium.

Besides, the refining furnace 60 is arranged on a connection pipe between the magnesium melting furnace 50 and the tundish 70 and supplies refined molten magnesium to the tundish 70. When magnesium ingot is melted, sludge and oxides such as intermetallic compounds are formed indispensably and the sludge and oxides are damaged to several units through which molten magnesium are passed for producing magnesium powder, deteriorating final magnesium powder quality. In order to avoid deteriorating magnesium powder quality, molten magnesium produced by melting magnesium ingot in the magnesium melting furnace 50 is guided to the refining furnace 60, instead of being supplied directly to the tundish 70. Here, the refining furnace 60 includes a heat-resistant pot 61, a cover 62, a tapping vessel 63, a cylinder valve 64, a transfer pipe 65 and a constant volume-casting melt transfer unit 66.

In addition, the heat-resistant pot 61 in which molten magnesium supplied from the magnesium melting furnace 50 is stored is configured such that inner part thereof with which molten magnesium is contacted is formed of low carbon steel and outer part thereof is formed of clad metal of nickel based heat-resistant alloy. Meanwhile, a barrier 61*a* having a predetermined height is formed inside the heat-resistant pot 61 to partition inner space thereof. Here, the barrier 61*a* formed in the heat-resistant pot 61 is provided for removing sludge or metal oxide from molten magnesium flowed in the heat-resistant pot 61. That is, sludge or metal oxide produced during melting magnesium ingot in a state of being mixed with molten magnesium is inputted into the heat-resistant pot 61 and at this time since the sludge or metal oxide is heavier than the molten magnesium, the sludge or metal oxide is settled to bottom surface of one space of partitioned spaces of the heat-resistant pot 61 and the settled sediment is blocked by the barrier 61*a* to avoid being moved to other spaces of the heat-resistant pot 61.

The cover 62 is provided for covering opened upper face of the heat-resistant pot 61 and allows inner part of the heat-resistant pot 61 to be vacuumed to some extent. This cover 62 is arranged tightly to the heat-resistant pot 61 and prevents outside air from entering therein or being outputted therefrom. Accordingly, inner vacuum degree inside the heat-resistant pot 61 can be adjusted only through a gas injection pipe 66*a* and a gas output pipe 66*b* of the constant volume casting melt transfer unit 66. A casting melt pipe 62*a* is provided on one side of the cover 62. The casting pipe 62*a* is connected to the magnesium melting furnace 50 and guides the molten magnesium to only one space among partitioned inner spaces of the heat-resistant pit 61.

Meanwhile, the tapping vessel 63 is provided on another space among inner spaces of the heat-resistant pot 61 partitioned by the barrier 61*a* except for one space on which the casting melt pipe 62*a* is arranged. That is, the tapping vessel 63 is arranged on one space on which sediments of the molten magnesium are not deposited, among inner spaces of the heat-resistant pot 61. In more detail, inner space of the heat-resistant pot 61 is partitioned to an input chamber R1 and a tapping chamber R2 by the barrier 61*a* wherein the input chamber R1 receives the molten magnesium through the casting melt pipe 62*a*, which is produced in the magnesium melting furnace 50 and further the tapping chamber R2 receives cleaned molten magnesium with sludge and metal oxide being removed in the input chamber R1. The tapping vessel 63 is provided on this tapping chamber R2. This tapping vessel 63 is fabricated such that it occupies about 30% of a total volume amount of the heat-resistant pot 61 and a casting melt input hole 63*a* may be formed on bottom face thereof.

On the other hand, the casting melt hole 63*a* is provided for inputting only cleaned molten magnesium in which sediments of sludge and metal oxide are removed, among molten magnesium inputted inside the heat-resistant pot 61 through the casting melt pipe 62*a*. In more detail, the molten magnesium inputted inside the heat-resistant pot 61 is kept in the input chamber R1 by the barrier 61*a* and sludge and metal oxide contained therein is deposited as sediment and further cleaned molten magnesium with sediment being removed flows along upper face of the barrier 61*a* in adjacent other space of the heat-resistant pot, that is, the tapping chamber R2. Therefore, based on the barrier 61*a*, molten magnesium on bottom face of which sediment is deposited exists in the input chamber R1 and cleaned molten magnesium with sediment being removed exists in the tapping chamber R2. The tapping vessel 63 is provided in the tapping chamber R2 of the heat-resistant pot 61 in which only cleaned molten magnesium exists wherein level of the cleaned molten magnesium is raised gradually to meet with, at some point, the casting melt input hole 63*a* formed on the bottom face of the tapping vessel 63 and when the level of the cleaned magnesium melt is raised further, it is inputted into the tapping vessel 63 through the casting melt input hole 63*a*.

Additionally, the cylinder valve 64 is provided on the cover 62 and functions to open or close the casting melt input hole 63*a* of the tapping vessel 63. This cylinder valve 64 is configured to move up-down and thus when molten magnesium is not necessary, the cylinder valve is moved to lower side to close the casting melt input hole 63*a* and when the molten magnesium is necessary, the cylinder valve is moved to upper side to open the closed casting melt input hole 63*a*.

The transfer pipe 65 is provided on the cover 62 and guides magnesium melt inside the tapping vessel 63 to the tundish 70. That is, the transfer pipe 65 is configured such that one end thereof is placed inside the tapping vessel 63 and the other end thereof is placed in the tundish 70 so that cleaned molten magnesium passing through the casting melt input hole 63*a* of the tapping vessel 63 is guided to the tundish 70.

Meanwhile, a sludge filter 65*a* is provided on one end of the transfer pipe 65 placed inside the tapping vessel 63. Sludge and metal oxide not removed by the barrier 61*a*, and sludge and metal oxide inside the molten magnesium, is removed using the sludge filter. In addition, casting melt heating unit 65*b* is provided on the transfer pipe 65 and heats the molten magnesium moving to the tundish 70 through the transfer pipe 65.

The constant volume casting melt transfer unit 66 is arranged to pass through the cover 62 and allows a constant volume of molten magnesium to be outputted toward the tundish 70 through the transfer pipe 65. Here, the constant volume casting melt transfer unit 66 includes a gas injection tube 66*a*, a gas output tube 66*b*, a gas supplying tank 66*c* and an output gas storage tank 66*d*.

The gas injection pipe 66*a* is arranged to pass through the cover 62 and one end thereof is placed inside the tapping vessel 63. The gas injection pipe 66*a* allows molten magnesium to be outputted through the transfer pipe 65 by injecting argon gas to the inside of the tapping vessel 63. In more detail, inner pressure of the tapping vessel 63 is increased by injecting argon gas to the inside of the tapping vessel 63 through the gas injection tube 66*a* and then the molten magnesium inside the tapping vessel 63 is moved through the transfer pipe 65 under the increased inside pressure of the tapping vessel.

The gas output tube 66*b* is arranged to pass through the cover 62 and one end thereof is placed inside the tapping vessel 63. This gas output tube 66*b* allows inner pressure of the tapping vessel 63 to be dropped down by outputting argon gas inside the tapping vessel 63 when inner pressure of the tapping vessel is elevated. When inner pressure of the tapping vessel 63 is decreased, amount of the molten magnesium moving through the transfer pipe 65 is decreased and as a result the amount of the molten magnesium supplied to the tundish 70 may be decreased.

The gas supplying tank 66*c* is connected to the other end of the gas injection tube 66*a* and supplies argon gas to the gas injection tube 66*a* and allows argon gas to be inputted to the inside of the tapping vessel 63.

The output gas storage tank 66*d* is connected to the other end of the gas output tube 66*b* and stores argon gas inside the tapping vessel 63, which is outputted through the gas output tube 66*b*.

Under the aforementioned configuration, inner pressure of the tapping vessel 63 is kept constant through the gas injection tube 66*a* and the gas output tube 66*b* and thus a constant amount of molten magnesium is supplied from the tapping vessel 63 to the tundish 70, making produced magnesium powder size to be constant. When molten magnesium is inputted from the tapping vessel 63 to the inside of the reactor 80 through the tundish 70, and flow amount of inputting molten magnesium is varied largely, average particle degree of produced magnesium powder is varied largely, making continuous manufacturing of fine magnesium powder difficult. Accordingly, the inner pressure of the tapping vessel 63 is controlled using the gas injection tube 66*a* and the gas output tube 66*b*.

The tundish 70 receives molten magnesium from the magnesium melting furnace 50 in which magnesium ingot is melted to form molten magnesium. However, the molten magnesium may be supplied to the tundish 70 from the refining furnace 60 which is provided between the magnesium melting furnace 50 and the tundish 70.

The reactor 80 receives heated argon gas from the gas heating unit 40 and produces magnesium powder by colliding the argon gas with molten magnesium supplied from the tundish 70. When argon gas is collided with molten magnesium inside the reactor 80, rapid injection of argon gas is necessary, since the size of produced magnesium powder by colliding argon gas with molten magnesium inside the reactor 80 inversely proportionate to injection speed of argon gas. That is, when argon gas is injected at a rapid speed to collide with molten magnesium, smaller size of magnesium powder is obtained. Accordingly, nozzle injection unit 81 is provided in the reactor 80 and the heated argon gas supplied from the gas heating unit 40 is injected at a rapid speed through the nozzle injection unit 81.

In the meantime, high temperature of the molten magnesium and argon gas which are collided inside the reactor 80 may be preferable since when high temperature of molten magnesium and argon gas are collided, yielding rate of spherical magnesium powder is high. For this reason, the casing melt heating unit 65*b* is provided on the transfer pipe 65 to heat molten magnesium and argon gas is compressed and heated using the gas compressor 30 and the gas heating unit 40.

In addition, molten magnesium is supplied from the tundish 70 to the reactor 80 wherein the molten magnesium is supplied from the tundish 70 to the inside of the reactor 80 through a casting melt supplying pipe 71. In more detail, the tundish 70 is arranged on a lower side of the reactor 80 and the casting melt supplying pipe 71 is provided between the tundish 70 and the reactor 80 and the molten magnesium inside the tundish 70 is supplied upwardly to the reactor 80 through the casting melt supplying pipe 71. Since the molten magnesium is supplied upwardly inside the reactor 80, the nozzle injection unit 81 is arranged on a lower side of the reactor 80 and nozzle provided therein injects upwardly argon gas to the inside of the reactor 80. Therefore, molten magnesium and argon gas, which are injected upwardly to the inside of the reactor 80, respectively, are collided with each other to produce spherical magnesium powder. The reason for producing magnesium powder by injecting molten magnesium and argon gas upwardly is that probability an accident such as fire may be less than downward injection of molten magnesium and argon gas.

The recovery unit 90 is provided for recovering magnesium powder produced in the reactor 80. This recovery unit 90 includes two recovery elements of cyclone type arranged in parallel and magnesium powder is recovered firstly and then not-recovered magnesium powder is recovered secondly.

The first gas cooler 100 cools argon gas passing through the recovery unit 90. That is, molten magnesium and argon gas are collided inside the reactor 80 and then the molten magnesium becomes spherical magnesium powder and the argon gas remains. Here, the spherical magnesium powder is recovered through the recovery unit 90 and remaining argon gas is inputted to the first gas gas cooler 100 without being recovered through special unit.

The filtering unit 110 removes dust from argon gas which decreases in temperature through the first gas cooler 100. Even though fine spherical magnesium powder is recovered through the recovery unit 90, magnesium dust of extremely small size or impurities are contained in the argon gas passing through the recovery unit 90 and the first gas cooler 100. This dust or impurities of extremely small size contained in argon gas is removed through the filtering unit 110. Here, the filtering unit 110 includes a dust collector 111 and a line filter 112. The dust collector 111 removes dust from argon gas passing through the first gas cooler 100 and the line filter 112 removes dust which is smaller size than that removed through the dust collector 111. That is, dust is removed firstly through the dust collector 111 and not-removed dust in the dust collector 111 having smaller size is removed through the line filter 112.

The buffer tank 130 is provided for receiving argon gas with dust being removed. In addition, a line blower 120 is provided between the line filter 112 of the filtering unit 110 and the buffer tank 130 and it functions to draw argon gas and supply it to the buffer tank 130 from the filtering unit 110 or prior units through which argon gas has passed. Here, the reason for providing the buffer tank 130 is intended that argon gas be stored first and then a uniform amount of argon gas is supplied to a compression blower 140 and a second gas cooler 150. A uniform amount of argon gas is supplied so that the argon gas is compressed and cooled uniformly through the compression blower 140 and the second gas cooler 150. Here, the compression blower 140 receives argon gas from the buffer tank 130 and compresses it adiabatically. Through this adiabatic compression flow velocity of argon gas is increased and at the same time temperature of argon gas is increased. In the meantime, the second gas cooler 150 receives the compressed and thus increased temperature argon gas in the compression blower 140 and cools the argon gas.

The static pressure buffer 160 is provided between the second gas cooler 150 and a adiabatic expansion duct 170 and further receives argon gas which is increased in flow velocity through the compression blower 140 and at the same time temperature thereof is decreased through the second gas cooler 150, and expands the argon gas to decrease further temperature of the argon gas.

The adiabatic expansion duct 170 is arranged on a lower side of the reactor 80, that is, on upper side of the nozzle injection unit 81 and functions to cool magnesium power produced inside the reactor 80. That is, the adiabatic expansion duct 170 receives argon gas which is increased in flow velocity and decreased in temperature in courses of passing through the compression blower 140, the second gas cooler 150 and the static pressure buffer 160, and adiabatically expands argon gas to decrease further temperature and increase further flow velocity, wherein the argon gas having increased flow velocity is injected to spherical magnesium powder produced by colliding molten magnesium supplied from the tundish 70 with argon gas passing through the gas heating unit 40 and injected through the nozzle injection unit 81 to cool the spherical magnesium powder. The reason for adiabatic expansion of argon gas in the adiabatic expansion duct 170 is intended so that spherical magnesium powder is cooled rapidly by decreasing temperature and increasing flow velocity of argon gas. Here, when cooling speed of spherical magnesium powder produced by colliding high temperature molten magnesium with high temperature argon gas is lowered, oxidation amount on a magnesium powder surface is increased to decrease combustion heat amount thereof and further spheroidizing roundness failure may occur to need a surface machining process for magnesium powder. For this reason, spherical magnesium powder is cooled rapidly to keep constant surface oxidation degree of magnesium and further surface stability and spheroidizing degree can be improved. Accordingly, surface machining process is not necessary.

Meanwhile, an oxidation agent supplying unit 20 is connected to a connection tube of the argon gas storage unit 10 and the gas compressor 30 and further a safety valve V is provided on a connection intersection part thereof. In addition, a pipe connected to the buffer tank 130 is connected to the safety valve V. Accordingly, the argon gas storage unit 10, the gas compressor 30, the oxidation agent supplying unit 20 and the buffer tank 130 are connected to each other based on the safety valve V.

While the present invention is described referring to the preferred embodiment, the present invention is not limited thereto, and thus various variation and modification can be made without departing from a scope of the present invention.

What is claimed:

1. A manufacturing device of spherical magnesium powder, comprising:

a gas compressor (30) for receiving argon gas from an argon gas storage unit (10) and compressing the argon gas;

a gas heating unit (40) for heating argon gas compressed in the gas compressor (30);

a tundish (70) for receiving molten magnesium from a magnesium melting furnace (50) in which a magnesium ingot is melted and molten magnesium is formed;

a reactor (80) which is provided with a nozzle injection unit (81) for receiving argon gas heated by the gas heating unit (40) and injecting the argon gas into the reactor, and which forms magnesium powder by colliding molten magnesium supplied from the tundish (70) with argon gas;

a recovery unit (90) for recovering magnesium powder produced in the reactor (80);

a first gas cooler (100) for cooling the argon gas passing through the recovery unit (90);

a filtering unit (110) for removing dust contained in the argon gas that was cooled by the first gas cooler (100);

a buffer tank (130) for receiving filtered argon gas from the filtering unit (110);

a compression blower (140) for receiving the argon gas from the buffer tank (130) and adiabatically compressing the argon gas;

a second gas cooler (150) for receiving the argon gas having increased temperature by compression in the compression blower (140) and cooling the argon gas; and an adiabatic expansion duct (170) for supplying the argon gas from the second gas cooler (150) and adiabatically expanding the argon gas, for supplying the expanded argon gas to the reactor (80), and for cooling magnesium powder produced inside of the reactor (80), wherein a refining furnace (60) for refining molten magnesium is further provided between the magnesium melting furnace (50) and the tundish (70) to supply refined molten magnesium to the tundish (70), wherein the refining furnace (60) comprises:

a heat-resistant pot (61) inside of which a barrier (61*a*) having a predetermined height is formed to partition an inner space thereof;

a cover (62) which opens and closes opened upper face of the heat-resistant pot (61), and on one side of which a casting melt pipe (62*a*) is connected to the magnesium melting furnace (50) to guide molten magnesium to one space of the partitioned inner space of the heat-resistant pot (61);

a tapping vessel (63) provided on another space of the partitioned inner space of the heat-resistant pot (61), wherein a bottom face of the tapping vessel having a casting melt input hole (63*a*);

a cylinder valve (64) provided in the cover (62) to open and close the casting melt input hole (63*a*) of the tapping vessel (63);

a transfer pipe (65) provided on the cover (62) to guide molten magnesium inside the tapping vessel (63) to the tundish (70); and a constant amount casting melt transferring unit (66) which is arranged to pass through the cover (62) and allows a constant amount of molten magnesium to be outputted through the transfer pipe (65).

2. The manufacturing device of spherical magnesium powder according to claim 1, wherein the casting melt transferring unit (66) comprises:

a gas injection pipe (66*a*) which is arranged to pass through the cover (62) and allows an inner pressure of the tapping vessel (63) to be increased by injecting the argon gas to an inside of the tapping vessel (63) and molten magnesium to be outputted through the transfer pipe (65);

a gas output pipe (66*b*) which is arranged to pass through the cover (62) and allows the argon gas to be outputted when the inner pressure of the tapping vessel (63) is elevated;

a gas supplying tank (66*c*) which is connected to the gas injection pipe (66*a*) and supplies the argon gas; and an outputted gas storage tank (66*d*) which is connected to the gas output pipe (66*b*) and stores outputted argon gas.

3. The manufacturing device of spherical magnesium powder according to claim 1, wherein a sludge filter (65*a*) is provided on a tip of the transfer pipe (65) inside the tapping vessel (63).

4. The manufacturing device of spherical magnesium powder according to claim 1, wherein a casting melt heating unit (65*b*) is provided on the transfer pipe (65) connecting the tundish (70) to the refining furnace (60).

5. The manufacturing device of spherical magnesium powder according to claim 1, wherein an oxidation agent supplying unit (20) is connected to a tube for supplying argon gas from the argon gas storage unit (10) to the gas compressor (30) and the argon gas mixed with an oxidation agent is supplied to the gas compressor (30).

6. The manufacturing device of spherical magnesium powder according to claim 1, wherein the tundish (70) is provided on a lower side of the reactor (80) and a casting melt supplying pipe (71) for supplying upwardly molten magnesium is provided between the tundish (70) and the reactor (80), and wherein the nozzle injection unit (81) is provided on a lower side of the reactor (80) and a nozzle provided in the nozzle injection unit (81) upwardly injects the argon gas to the inside of the reactor (80) so that molten magnesium supplied upwardly to the inside of the reactor (80) through the casting melt supplying pipe (71) collides with the argon gas.

7. The manufacturing device of spherical magnesium fine powder according to claim 1, wherein the filtering unit (110) includes a dust collector (111) for removing dust contained in argon gas passing through the first gas cooler (100), and a line filter (112) for removing smaller dust than the dust filtered from the dust collector (111).

8. The manufacturing device of spherical magnesium fine powder according to claim 1, wherein a static pressure chamber (160) is further provided between the second gas cooler (150) and the adiabatic expansion duct (170).

* * * * *